US006887366B2

(12) United States Patent
Lettmann

(10) Patent No.: US 6,887,366 B2
(45) Date of Patent: May 3, 2005

(54) REPAIR METHOD FOR TEXTURED AND/OR SMOOTH STEEL SURFACES ON ENDLESS STRIPS OR PRESSING SHEETS

(75) Inventor: Heinz-Peter Lettmann, Krefeld (DE)

(73) Assignee: Hueck Engraving GmbH, Viersen (DE)

( * ) Notice: Subject to any disclaimer, the term of this patent is extended or adjusted under 35 U.S.C. 154(b) by 114 days.

(21) Appl. No.: 10/259,213

(22) Filed: Sep. 27, 2002

(65) Prior Publication Data

US 2003/0089610 A1 May 15, 2003

(30) Foreign Application Priority Data

Sep. 28, 2001 (DE) ..... 101 48 045

(51) Int. Cl.[7] ..... C25D 5/02; C25D 5/36; C25D 3/56

(52) U.S. Cl. ..... 205/115; 205/211; 205/259

(58) Field of Search ..... 205/115, 117, 205/147, 211, 217, 270, 271, 283, 259; 427/259, 282, 328, 405, 142, 430.1; 204/485

(56) References Cited

U.S. PATENT DOCUMENTS 4,738,756 A * 4/1988 Mseitif ..... 205/50
4,834,844 A * 5/1989 Pliefke et al. ..... 205/115
6,146,516 A 11/2000 Lettmann

FOREIGN PATENT DOCUMENTS

DE 8129270 10/1982
DE 195 48 198 3/1997
DE 14548198 7/1997
EP 0 031 613 A1 7/1981
WO WO90/04052 4/1990

OTHER PUBLICATIONS

Taschenbuch für Galvanotechnik (Pocket book for galvanotechnology), vol. 1, 1988, p. 472 (to follow).

Schriftenreihe Galvantechnik, "Das Tampongalanisieren", by von Dr. Marvin Rubinstein (pp. 138–162).

* cited by examiner

*Primary Examiner*—Roy King
*Assistant Examiner*—Harry D Wilkins, III
(74) *Attorney, Agent, or Firm*—Collard & Roe, P.C.

(57) ABSTRACT

A method for touching up and/or repairing minor surface damage in a large-format pressing plate or an endless strip 3 made of steel sheet, with a textured surface 4, for surface embossing of wood materials or laminate panels, has the damaged surface subjected to microgalvanic treatment. In order to simply repair the damage locations and to allow a longer tool life of the pressing sheets, it is provided, that an electrolyte solution that contains metal ions and iron is used, which is coordinated with the base material of the pressing plate or the endless strip 3. This yields the particular advantage that no color deviations are formed as compared with the damaged locations and that a conventional chromium-plating process can be used. Thus the damaged locations 2 are not washed out and thereby become visible again, during subsequent touch-up chromium-plating, because of the electrolyte used.

17 Claims, 1 Drawing Sheet

Figure 1:
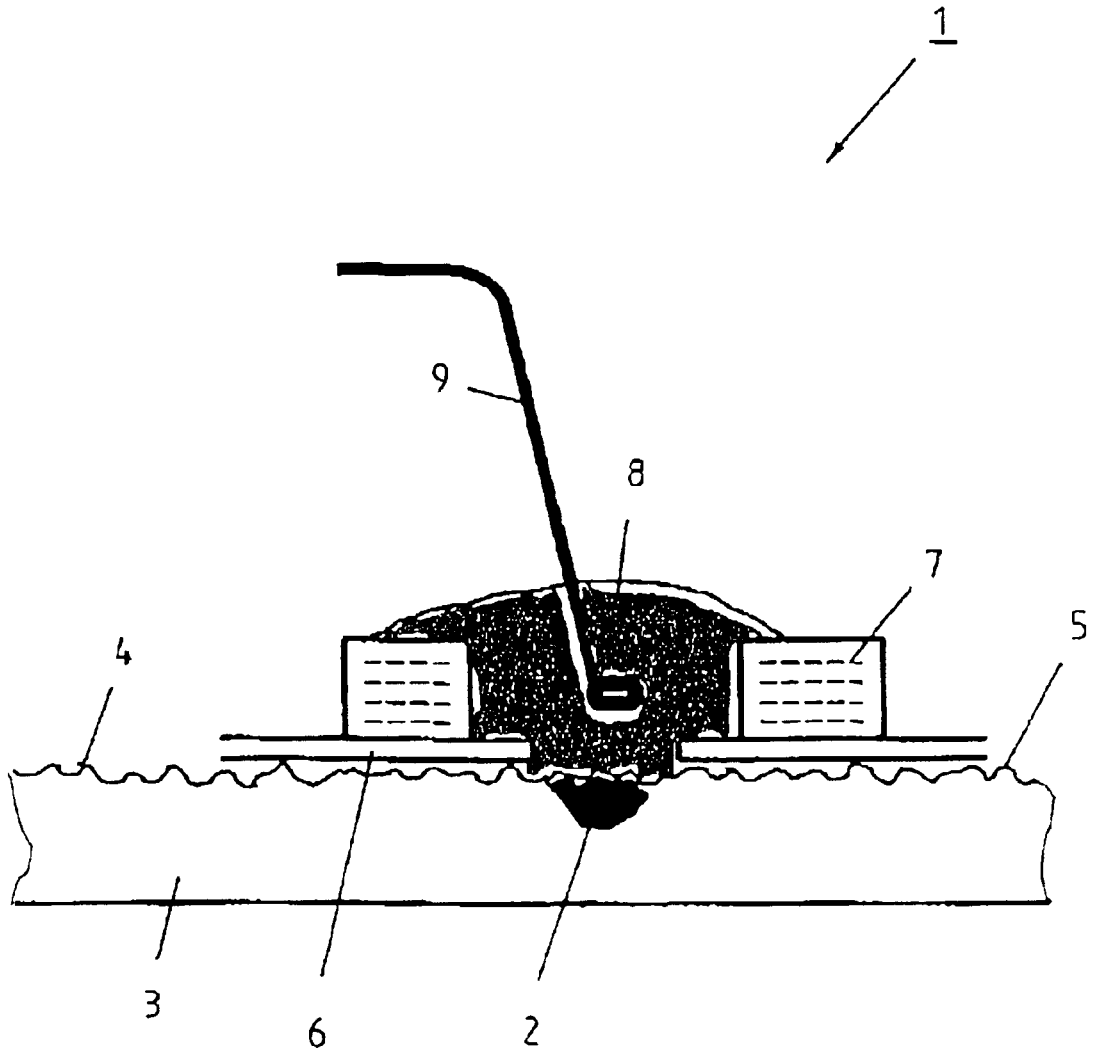

REPAIR METHOD FOR TEXTURED AND/OR SMOOTH STEEL SURFACES ON ENDLESS STRIPS OR PRESSING SHEETS

The invention relates to a method for touching up and/or repairing minor surface damage in a large-format pressing plate or an endless strip made of steel sheet, with a textured surface, for surface embossing of wood materials or laminate panels, the damaged surface being subjected to micro-galvanic treatment.

In the production of furniture, for example kitchen furniture, textured surfaces are required which have an appealing appearance, on the one hand, and are easy to take care of, on the other hand. For this purpose, plastic-coated wood material panels or laminate panels are used, which are given an embossed texture on their surface, embossing of such a texture being carried out using large-format pressing sheets or endless strips. For the aforementioned reasons, the pressing sheets and/or endless strips are therefore subject to very great stress, and it can happen, again and again, that hard inclusions are present in the wood material or laminate, for example, which easily damage the pressing sheets or endless strips at their surface.

The finished pressing sheets are installed in a pressing device with which the plastic-coated furniture panels or the like are produced. For this purpose, endless strips that run in a circular motion are used, for example, which allow continuous production, the pressed goods being pressed into panels between the endless strips, and the surface being textured. For this purpose, the endless strips and/or pressing plates have the aforementioned surface texture, which is embossed into the pressed laminate. Any surface damage that is present is embossed into the pressed laminate, so that the panels that are produced, which might be partly damaged, cannot be used for further production. For this reason, it is particularly important that the pressing sheets and/or endless strips that are used have absolutely perfect surfaces, in order to keep any scrap as low as possible. However, it cannot always be avoided that minor surface damage occurs in the production of pressing plates and/or endless strips, or during their use in the pressing plant, for example cracks, indentations, bubbles or the like. Surface damage of this type is generally very small, with a damage area of 1 to 14 $mm^2$,and it can occur in the steel sheet itself, in the textured metal coating, in the hard chromium layer, or possibly in all the layers.

Such damage is directly transferred to the wood material panels or laminate panels during later pressing processes, so that the surface texture is defective and might become visible in an exposed position, if the panel is cut a particular way. To avoid major scrap, it is therefore necessary to repair any damage that exists in the pressing plates or the endless strips. Because of the fact that the pressing plates consist of steel or brass sheets with a textured surface, or of a steel plate coated with copper or brass, the surface texture being worked into the softer coating, which is subsequently provided with a hard chromium plating, a complicated process is necessary in order to correct the damage.

The method is used for large-format pressing plates or endless strips, in order to touch up such surface damage or damage locations, so that the relatively expensive pressing plates and/or endless strips can continue to be used. Surface damage can occur as early as during texturing of the pressing plates or endless strips, for example, or during their subsequent use for work. For this purpose, the pressing plates or endless strips are sent back to the manufacturing plant. Preferably, these are pressing plates or endless strips made of steel sheet or brass sheet, which have a texture directly on their surface. In this connection, the surface texturing is selected from a large number of patterns, in accordance with the customers' wishes.

A touch-up during the production of the pressing sheets or endless strips is either not possible at all or is very time-consuming and therefore accordingly expensive. If there is damage in steel sheet that has not yet been coated, it is true that the damage can be repaired by etching the sheet one or more times, but this results in repair costs that are approximately equal to or greater than the acquisition costs for new pressing sheets or endless strips. If the existing damage goes into the hard chromium layer or possibly into the steel layer, it can be repaired in that the chromium layer and the steel layer are completely pickled, over the entire surface, and then the last surface is newly coated with copper or brass and chromium-plated but this measure is also very complicated and expensive.

To correct such damage, it is known, for example from the Taschenbuch für Galvanotechnik [Pocket book for galvanotechnology], Volume 1, 1988, page 472, to combine an anode with a tampon that is saturated with electrolyte. The tampon is constantly supplied with fresh electrolyte, and must constantly be moved intensively. However, smaller damage areas between approximately 1 and 14 $mm^2$ cannot be properly touched up or repaired using this method.

Furthermore, a manual device is known from DE 81 29 270 U1, for bimetallic metal deposition, which is provided with a plastic fiber electrode that is inserted into a cuff made of platinum, switched as an anode. This fiber electrode is saturated in electrolyte and moved on the damage site with friction. Also, a manual device with a metal electrode is known from WO 900 40 52 A1, which electrode is moved with friction over a filter paper that has been saturated with electrolyte and is placed over the damage location. Both devices serve for tampon galvanization, in which the devices have to be moved over the damage location with friction.

Furthermore, a method for touching up and/or repairing minor surface damage is known from the German patent DE 195 48 198, in which each damage location is framed with a mask, pickled, and galvanically copper-plated. In this connection, the galvanic copper plating takes place in micro-galvanic manner, in that a galvanic copper solution is applied to every framed and pickled damage location of the sheet switched as a cathode, and an electrode tip switched as an anode is dipped into this solution. After the damage area has been filled up, it can be re-textured in accordance with the existing surface structure, and can be subjected to further finishing processes, for example hard chromium plating. However, it has proven to be disadvantageous that in the case of repeated repair procedures, and in particular in the case of removal of the hard chromium plating, the damage locations filled up with copper are also washed out, and therefore a repeat follow-up treatment of the damage locations that were already present is required. Therefore, over the course of time, the number of damage locations and the required follow-up treatments continuously increases, and therefore they can no longer be efficiently repaired.

It is the task of the present invention to indicate a new method for touching up and/or repairing surface damage, with which a repair of the damage locations is possible, the repair assuring a longer serviceable life.

According to the invention, in order to accomplish the task, it is provided that an electrolyte solution that contains metal ions and iron is used by means of which a deposition of iron, nickel, and/or chromium metal ions takes place, the mixture ratio of the metal ions contained in the electrolyte solution being coordinated with the base material of the pressing plate or the endless strip.

Electrolyte solutions that contain iron possess the advantage, for example, that no color deviation will occur as compared with the non-damaged locations, and conventional chromium-plating processes can be used, without the damage location being washed out during subsequent chromium-plating processes and thereby becoming visible. The layer build-up provided for filling up the damage location with electrolyte solutions that contain iron further more results in increased strength and thereby in a significantly longer tool life of the pressing plate or the endless strip. By means of the electrolyte, i.e. the electrolyte solution, a deposition of iron, nickel and/or chromium metal ions is brought about, so that the existing damage is evened out by means of a deposition of a mixture of iron, nickel, and chromium and therefore the method can preferably be used in the treatment of pressing plates or endless strips that are made of steel. In this connection, the mixture ratio of the metal ions present in the electrolyte solution is coordinated with the base material of the pressing plate or the endless strip, in each instance. Preferably, bivalent and trivalent metal ions $Fe^2$, $Fe^3$ are used for the electrolyte solution in a ratio of 2:1.

The method according to the invention is therefore preferably suited for filling up damage locations on directly textured steel pressing plates or steel endless strips, whereby different electrolytes can be used under different general conditions, in accordance with the further processing steps, so that different degrees of hardness of the filling layer or protective layer, for example, can be achieved. However, the method can also be used, for example, where filling with copper has already taken place, and specifically, a nickel layer is first applied for this purpose, and subsequently provided with a coating consisting of iron, chromium, and/or nickel ions, and subjected to hard-chromium-plating.

The optimum method for metal fillings in the case of directly textured strips must deposit a medium-hard layer, and particularly one that can be chromium-plated, and which can still be touched up mechanically (manual texturing). For protective repairs in the case of directly textured strips, on the other hand, a thin, soft layer that can be chromium-plated, must be deposited, and it must also be possible to work it mechanically, if necessary. For finish repairs in the case of treatment strips, a thin but also hard layer must be deposited, while in the case of protective repairs before standard chromium-plating, a thin but also soft layer must be deposited, which can still be worked mechanically.

For the deposition of iron, nickel and chromium compounds, a fixed electrode, for example a tampon electrode, is used for a damage area of up to a maximum of 30 $mm^2$. In this connection, the repair process takes place after the end of the surface texturing, which means that etching has been carried out and, if necessary; the pressing plate or endless strip has been mechanically polished. A pretreatment of the damaged surface can take place, for example, by means of a mechanical cleaning and then cleaning with methanol, and subsequently a modified cleaning electrolyte is used for degreasing, using the microgalvanization device. Subsequently, a modified electrolyte is used for further pretreatment of the damaged surface, which electrolyte is used for activation of steel or chromium surfaces. For degreasing, a potash and soda lye in a mixture of 1:1 is used, and for activation, a solution that contains hydrogen difluoride is used. For the repair of damage locations that have already been filled up with copper, a nickel electrolyte is preferably used, in order to provide a nickel coating so that further treatment with a steel electrolyte can take place, and later during hard-chromium-plating, the filling is not washed out. The selection of the electrolytes used depends on how the further treatment of the damaged surface is supposed to take place. In the case where touch-up texturing is required, a soft-chromium electrolyte can be used, for example, which is subjected to later subsequent treatment, after the texturing has taken place.

For the case where touch-up texturing is not required, a modified hard-chromium or steel electrolyte can be used for the treatment of the damaged surface, the modified hard-chromium electrolyte containing sulfate/methane sulfonic acid, and having a proportion of 290±5 g/liter chromic acid with 1.0±0.1% sulfuric acid concentrate, and the modified steel electrolyte containing ammonium formiate and consisting of an 82% iron solution, 13% chromium solution, and 5% nickel solution, for example. In the case of the modified hard-chromium electrolyte, this is an expanded electrolyte that consists of chromic acid and slufuric acid, the mixture ratio having been changed, and 290±5 g/liter chromic acid and a concentration of 1.2±0.1% sulfuric acid being present, for example. This composition is similar to that of a gloss chromium electrolyte and can be used with different current densities. A solution of an 82% iron solution, 13% chromium solution, and 5% nickel solution, which cannot be stored and must be mixed up fresh each time, is used as the modified steel electrolyte. Depending on the use, deposition of a soft fill layer or a hard protective layer with a thickness of approximately 20 to 30$\mu$ and approximately 47 to 60 HRC is carried out, which has a composition of iron, chromium, and nickel on which the base material is based. After filling up has taken place, the surface is partially re-textured by hand, in order to subsequently carry out hard-chromium-plating, for example, the pressing plate or the endless strip being hard-chromium-plated over its entire area after re-texturing, and polished.

In a development of the invention, it is provided, in this connection, that different electrolytes are used individually, or in combination, one after the other, for treatment of the damaged surface. A steel electrolyte, for example, can be used at a temperature of 47 to 50° C., at a current density of 6 $mA/mm^2$.The steel electrolyte consists, for example, of 50 ml iron solution, 5 ml chromium solution, and 2.5 ml nickel solution. In contrast, a soft-chromium electrolyte containing sulfate can be used at a temperature of 58 to 60° C. and a current density of 0.3 $mA/mm^2$. A hard-chromium electrolyte containing sulfate/sulfonic acid can furthermore be used at a temperature of 70 to 73° C. and a current density of 4 $mA/mm^2$, while an electrolyte used for filling up the damaged surface, for example, is used at a current density of 1.5 to 4 $mA/nm^2$, and a temperature of 47 to 50C.

By means of the different electrolytes, the method according to the invention permits a very simple and inexpensive partial touch-up or repair of minor surface damage in the pressing plates and endless strips, resulting in the aforementioned advantages on the basis of the electrolytes used, with a deposition of iron, nickel and chromium, and furthermore allows repeated hard-chromium-plating according to known methods, for example the Brunner method, without the filled-up materials being washed out.

For use of the method, a microgalvanization device is furthermore being proposed, whereby each damaged surface is framed by a mask, so that the electrolyte solution being used completely wets the damage location, whereby a fixed electrode is dipped into the electrolyte solution, and a free-wheel rectifier being used, which is connected with the steel sheet by way of an electrode, on the one hand, and with a connection terminal, on the other hand. In this connection, the mask protects the non-damaged edge zones of the damage locations from the galvanic solutions and delimits the damaged region that is to be filled up. In this connection, the mask absorbs the electrolyte being used in a sufficient amount; this is assured, for example, by means of a multi-layer structure of the mask. As compared with previously known methods, the electrolyte treatment according to the deposition process is limited in time, and after the process has been completed, the remaining electrolyte is removed and the formerly damaged location is treated by flushing it, so that the pressing plates or endless strips can be passed to further processing. This can consist of touch-up texturing or hard-chromium-plating, for example.

In this connection, the mask consists of a bottom adhesive layer that is glued directly onto the pressing plate or endless strip, and a multi-layer mask structure set onto the adhesive layer, so that the electrolyte can be absorbed in a sufficient amount. A prerequisite for this is that the material of the mask is temperature-resistant, because the electrolytes used are used at a temperature of 47 to 73° C. The electrode consists of a plate-shaped tamponade electrode, which is fixed in place and dips into the electrolyte, whereby the anode area should have a ratio of 1:0.9 to the cathode area. The actual microgalvanic treatment of the damaged locations takes place as a function of the current intensity and is limited in time, the duration of the treatment not being determined by the amount of electrolyte, but rather the electrolyte being made available in a sufficient amount, or being filled up as necessary.

The pressing sheets and endless strips can be touched up by means of the microgalvanic repair method, in their production, in all processing states or, if necessary, pressing sheets and endless strips that were damaged in use can be subjected to subsequent treatment. In this connection, touch-up texturing always takes place in accordance with the existing surface texturing, so that the damage locations are no longer evident to an observer after the treatment has taken place and, in particular, no color deviation is visible before and after chromium plating, by means of using suitable electrolytes.

The invention will be explained in greater detail below, according to the examples listed:

EXAMPLE 1

A pressing plate or an endless strip with a directly textured and mechanically polished steel surface layer, with a defect depth >25$\mu$ caused by an etching error, mechanical damage, or a material defect, is supposed to be touched up. The damaged area is first cleaned mechanically and deoxidized, as well as cleaned with methanol, and subsequently a multi-layer mask is glued on around the defect, framing the damage location, where the overlap should not be more than 0.5 mm all around. Subsequently, the mask is filled up with a cleaning electrolyte and a microgalvanization device is applied, a fixed tamponade electrode, which is switched as a cathode, being dipped into the cleaning electrolyte. At a current density of about 4 mA/mm$^2$ at a voltage of 10 volts, the microgalvanization device is used for degreasing at room temperature, for about 60 seconds. Afterwards, the remaining electrolyte is removed and the damage location is flushed.

After flushing, the damage location is activated with another electrolyte, whereby the activation electrolyte, for example an activation solution containing hydrogen difluoride, is filled into the existing mask. Activation takes place cathodically, at a current density of 4 mA/mm$^2$ and a voltage of 8 volts, for a period of 60 seconds and at room temperature, and subsequently in the current-free state, for a period of 180 seconds at room temperature. After flushing, a sub-coating of nickel is applied with a nickel electrolyte, whereby the tamponade electrode being used is switched as a cathode, and used at a current density of 4 mA/mm$^2$ and a voltage of 8 volts for a period of 45 seconds at room temperature. During this process, the deposition of a layer with a thickness of approximately 0.4$\mu$ takes place. After the sub-coating of nickel has been applied, the nickel electrolyte is removed, without any further flushing taking place.

The defect is filled up after a new mask is fixed in place, using a steel-like electrolyte and a tainponade electrode at a distance of min. 3 mm from the metal surface, whereby cathode poling takes place and the current is slowly regulated higher at a current density of 4 mA/mm$^2$ and a voltage of 10 volts, over a period of eight minutes. In this connection, filling up takes place at an electrolyte temperature of 48–50° C., and results in a deposited layer thickness of approximately 25 $\mu$. Subsequently, the damage location is flushed, and checked mechanically to determine whether or not the metal filling is sufficient for any manual texturing that is to be applied. If the layer thickness is not yet sufficient, the last process steps have to be repeated until a sufficient layer thickness is present. If the depression in the damage location has been sufficiently filled up with a steel coating, the electrolyte is dabbed off, the mask is removed, and the filled-up damage location is thoroughly washed. This is followed by manual texturing and mechanical polishing. The touched-up pressing sheet or endless strip is subsequently hard-chromium-plated over its entire area, in usual manner, for example using the Brunner chromium-plating method.

The new repair method is based on the deposition of a soft, steel-like fill layer with a thickness of 20–30 $\mu$ and approximately 47 HRC, which acts similar to the band steel in the case of anode poling in the chromium bath, according to the Brunner chromium-plating method, and which results in optically similar surfaces during subsequent chromium metallization. In this connection, the chemical composition of the steel electrolyte was established in such a way that the metal deposition that took place possesses an alloy composition similar to that of the band steel, in the form of iron, chromium, and nickel. The aforementioned repair method is carried out after the end of texturing, in other words etching and mechanical polishing, and the hardness of the steel fill layer cannot be influenced. If any chromium removal using electrolyte becomes necessary at a later time, the fill layer is not attacked by it, so that the pressing plate or endless strip being used can be chromium-plated several times.

EXAMPLE 2

A pressing plate or an endless strip with a directly textured and mechanically polished steel surface layer, [words missing] which has been caused by an etching error, mechanical damage, or a material defect, is supposed to be touched up, where the damaged area has previously been filled up with copper and re-textured by hand, with subsequent polishing. The damaged area is first cleaned with methanol, and subsequently, a multi-layer mask is glued on in accordance with Example 1. Subsequently the mask is filled up with a cleaning electrolyte and a microgalvanization device is applied, a fixed tamponade electrode, which is switched as a cathode, being dipped into the cleaning electrolyte. At a current density of about 4 mA/mm$^2$ and a voltage of 10 volts, the microgalvanization device is used for degreasing at room temperature, for about 60 seconds.

Afterwards, the remaining electrolyte is removed and the damage location is flushed.

After flushing, the damage location is activated with another electrolyte, according to Example 1. After flushing, a sub-coating of nickel is applied with a nickel electrolyte, also according to Example 1.

Touch-up of the defect takes place after application of a new mask and a tamponade electrode at a distance of min. 3 mm from the metal surface, whereby cathode poling takes place and the current is slowly regulated higher at a current density of 6 mA/mm$^2$ and a voltage of 10 volts, over a period of ten seconds. In this connection, touch-up takes place at an electrolyte temperature of 48–50° C., and results in a deposited layer thickness of approximately 2.5–2.8 $\mu$. Subsequently, the damage location is flushed and the steel tamponade is carefully polished with polishing paste. This is followed by mechanical polishing. The touched-up pressing sheet or endless strip is subsequently hard-chromium-plated over its entire area in usual manner, for example using the Brunner chromium-plating method.

The repair method is based on the deposition of a soft, steel-like fill layer with a thickness of 2.5–2.8 $\mu$ and approximately 47 HRC, which acts similar to the band steel in the case of anode poling in the chromium bath, according to the Brunner chromium-plating method, and which results in optically similar surfaces during subsequent chromium metallization. In this connection, the chemical composition of the steel electrolyte was established in such a way that the metal deposition that took place possesses an alloy composition similar to that of the band steel, in the form of iron, chromium, and nickel. The aforementioned repair method is carried out after the end of texturing, in other words etching and mechanical polishing, whereby copper can be replaced with steel as a fill material. If any chromium removal using electrolyte becomes necessary at a later time, the fill layer is not attacked by it, so that the pressing plate or endless strip being used can be chromium-plated several times.

EXAMPLE 3

A pressing plate or an endless strip with a directly textured and mechanically polished steel surface, or in copper-filled strips, is supposed to be touched up, whereby a defect has been caused by mechanical damage, and has already been filled up with copper or steel and textured and matte-finished by hand, and a repair takes place before the degree of gloss is increased. The damaged area is first cleaned with methanol, and subsequently a multi-layer mask is glued on in accordance with Example 1. Subsequently, the mask is filled up with a cleaning electrolyte and a microgalvanization device is applied, a fixed tamponade electrode, which is switched as a cathode, being dipped into the cleaning electrolyte. At a current density of about 4 mA/mm$^2$ and a voltage of 8 volts, the microgalvanization device is used for approximately 60 seconds at room temperature. Afterwards, the remaining electrolyte is removed and the damage location is flushed.

a) After flushing, the damage location filled up with copper is activated with another electrolyte, whereby the activation electrolyte, for example an activation solution containing hydrogen difluoride, is filled into the existing mask. Activation takes place cathodically, at a current density of 4 mA/mm$^2$, for a period of 60 seconds and at room temperature, and subsequently in the current-free state, for a period of 180 seconds, also at room temperature.

b) After flushing, the damage location filled up with steel is activated with another electrolyte, whereby the activation electrolyte, for example an activation solution containing hydrogen difluoride, is filled into the existing mask. Activation takes place cathodically, at a current density of 3 mA/mm$^2$, for a period of 60 seconds and at room temperature, and subsequently in the current-free state, for a period of 180 seconds, also at room temperature.

After flushing, a sub-coating of nickel is applied in cases a) and b), with a nickel electrolyte, according to Example 1. In this connection, the deposition of a layer with a thickness of approximately 0.5$\mu$ takes place. After the sub-coating of nickel has been applied, the nickel electrolyte is removed, without any further flushing taking place.

Touch-up of the defect takes place after application or a new mask and a tamponade electrode at a distance of min. 3 mm from the metal surface, whereby cathode poling takes place and the current is slowly regulated higher at a current density of 3 mA/mm$^2$ and a voltage of 10 volts, over a period of 80 seconds. In this connection, touch-up takes place at an electrolyte temperature of 70–73° C., and results in a deposited layer thickness of approximately 2.7 $\mu$. Subsequently, the damage location is flushed and the deposited chromium is polished by hand. A modified chromium electrolyte is used, which contains sulfate and methane sulfonic acid. The touched-up pressing sheet or endless strip is subsequently polished to a high gloss.

The new repair method is based on the deposition of a hard chromium layer with a thickness of 3 $\mu$ and approximately 60 HRC. The deposited chromium (finish) can be polished in such a way that a uniform chromium-colored repair location is obtained. The defects repaired according to the new method have a clearly longer useful lifetime than treatment strips repaired using cobalt finish.

EXAMPLE 4

A pressing plate or an endless strip with a directly textured and mechanically polished surface layer, with chromium-plated band steel, possibly with a copper sub-coating, being used as the substrate, is supposed to be touched up. Texturing takes place directly in the steel or in the copper layer, with etching errors, mechanical damage, or material defects being present. The damaged area is first cleaned with methanol, and subsequently, a multi-layer mask is glued on in accordance with Example 1. Subsequently, the mask is filled up with a cleaning electrolyte and a microgalvanization device is applied, a fixed tamponade electrode, which is switched as a cathode, being dipped into the cleaning electrolyte. At a current density of about 4 MA/mm$^2$, the microgalvanization device is used at room temperature, for about 60 seconds. Afterwards, the remaining electrolyte is removed and the damage location is flushed.

After flushing, the damage location is activated with another electrolyte, whereby the activation electrolyte, for example an activation solution containing hydrogen difluoride, is filled into the existing mask. Activation takes place cathodically, at a current density of 4 mA/mm$^2$ and a voltage of 10 volts, for a period of 60 seconds and at room temperature, and subsequently in the current-free state, for a period of 180 seconds, at room temperature. After flushing, a sub-coating of nickel is applied with a nickel electrolyte, according to Example 1. In this connection, a layer thickness of approximately 0.5 $\mu$ is applied. After the nickel sub-coating has been applied, the nickel electrolyte is removed, without any further flushing taking place. Touch-up of the defect takes place after application of a new mask and a tamponade electrode at a distance of min. 3 mm from the metal surface, whereby cathode poling takes place and the current is slowly regulated higher at a current density of 0.45 mA/mm$^2$ and a voltage of 8 volts, over a period of 180 seconds. In this connection, touch-up takes place at an electrolyte temperature of 58–60° C., and results in a deposited layer thickness of approximately 1.7 $\mu$. Subsequently, the damage location is flushed and the transitions between the repair location and the steel layer are mechanically touched up. The touched-up pressing sheet or endless strip is subsequently hard-chromium-Plated over its entire area, in usual manner, for example using the Brunner chromium plating method.

The new repair method is based on the deposition of a soft, steel-like protective layer with a thickness of approximately 2$\mu$ and approximately 50 HRC, using an electrolyte that contains sulfate.

The microgalvanization device used will be explained in greater detail below, on the basis of the single FIGURE.

FIG. 1 shows a microgalvanization device 1 that [words missing—is used] for repairing a damage location 2 on the surface of a pressing plate or an endless strip 3 that has been caused by mechanical damage. The surface 4 of the pressing plate or the endless strip 3 has a texture 5 that must be re-textured mechanically, in appropriate manner, after use of the microgalvanization device 1. For this purpose, a mask 6 is first glued directly onto the texture 5, and a second mask 7, for example made of twelve layers of adhesive tape (tape), is set on. The masks 6 and 7 are arranged around the damage location 2 to such an extent that only a slight overlap of approximately 0.5 mm is present. Because of the electrolytes used, with an application temperature of up to 73° C., it is necessary, in this connection, that the masks 6, 7 are temperature-resistant. The masks 6, 7 extend around the damage location 2 and furthermore serve to hold the electrolyte 8 that is used, into which a plate-shaped tamponade electrode 9 is dipped. The tamponade electrode 9 as well as the pressing plate or the endless strip 3 are switched either as the cathode or the anode for using the method.

REFERENCE SYMBOL LIST

1. Microgalvanization device
2. Damage location
3. Endless strip
4. Surface
5. Texture
6. Mask
7. Mask
8. Electrolyte
9. Tamponade electrode

What is claimed is:

1. Method for touching up and/or repairing minor surface damage in a large-format pressing plate or an endless strip made of steel sheet, with a textured surface, for surface embossing of wood materials or laminate panels, the damaged surface being subjected to microgalvanic treatment, wherein an electrolyte solution that contains iron and nickel or iron and chromium or iron and nickel and chromium is used, by means of which a deposition of iron, nickel, and/or chromium metal ions takes place, the mixture ratio of the metal ions contained in the electrolyte solution being coordinated with the base material of the pressing plate or the endless strip, wherein the electrolyte solution contains ammonium formiate.

2. Method according to claim 1, wherein the electrolyte solution contains bivalent and trivalent metal ions $Fe^2$, $Fe^3$ in a ratio of 2:1.

3. Method according to claim 1, wherein a damage area of up to a maximum of 30 $mm^2$ is treated with a fixed electrode, or a tamponade electrode.

4. Method according to claim 1, wherein the repair process takes place after the end of texturing, which means etching and, if necessary, mechanical polishing.

5. Method according to claim 1, wherein for pretreatment of the damaged surface, mechanical cleaning and then cleaning with methanol takes place.

6. Method according to claim 1, wherein for pretreatment of the damaged surface, a modified cleaning electrolyte is used for degreasing, or for activation of steel or chromium surfaces, which consists of a potash and soda lye in a mixture ratio of 1:1 for degreasing, and of a solution that contains hydrogen difluoride for activation.

7. Method according to claim 1, wherein the damaged surface is nickel-plated before further processing.

8. Method according to claim 1, wherein in the case where touch-up texturing is required, a soft-chromium electrolyte is used for further treatment of the damaged surface.

9. Method according to claim 8, wherein after filling up has taken place, the surface of the damaged locations can be partially re-textured.

10. Method according to claim 1, wherein for further treatment of the damaged surface without touch-up texturing, a modified hard-chromium or steel electrolyte is used, whereby the modified hard-chromium electrolyte contains sulfate/methane sulfonic acid, and has a proportion of 290±5 g/liter chromic acid with 1.0±0.1% sulfuric acid concentrate, and the modified steel electrolyte contains ammonium formiate and consists of an 82% iron solution, 13% chromium solution, and 5% nickel solution.

11. Method according to claim 1, wherein deposition of a soft or hard steel fill layer with a thickness of approximately 20–30$\mu$ and approximately 47 to 60 HRC is carried out, which has a composition of iron, chromium, and nickel on which the base material is based.

12. Method according to claim 1, wherein the pressing plate or the endless strip is hard-chromium-plated over its entire area after re-texturing.

13. Method according to claim 1, wherein different electrolytes are used individually, or in combination, one after the other, for treatment of the damaged surface.

14. Method according to claim 1, wherein a steel electrolyte is used at a temperature of 47 to 50° C., at a current density of 6 $mA/mm^2$, whereby the steel electrolyte consists, of 50 ml iron solution, 5 ml chromium solution, and 2.5 ml iron solution.

15. Method according to claim 1, wherein a soft-chromium electrolyte containing sulfate is used at a temperature of 58 to 60° C. and a current density of 0.3 $mA/mm^2$.

16. Method according to claim 1, wherein a hard-chromium electrolyte containing sulfate/sulfonic acid is used at a temperature of 70 to 73° C. and a current density of 4 $mA/mm^2$.

17. Method according to claim 1, wherein an electrolyte used for filling up the damaged surface is used at a current density of 1.5 to 4 $mA/mm^2$ at a temperature of 47 to 50° C.

* * * * *